United States Patent [19]

Mock, Jr. et al.

[11] 4,429,212

[45] Jan. 31, 1984

[54] DISPOSABLE ELECTRIC LIGHTER

[76] Inventors: Sam D. Mock, Jr., Rte. 1 Box 697, Smith's Station, Ala. 36877; Curtis D. Mock, 119 Swimming Pen Dr., Doctor's Inlet, Fla. 32020

[21] Appl. No.: 249,921

[22] Filed: Apr. 1, 1981

[51] Int. Cl.[3] ..... F23Q 7/16

[52] U.S. Cl. ..... 219/268; 219/262; 219/267

[58] Field of Search ..... 219/260, 262, 264, 265, 219/267, 268, 270; 361/264, 265, 266; 431/262

[56] References Cited

U.S. PATENT DOCUMENTS

| | | | |
|---|---|---|---|
| 1,898,418 | 2/1933 | Zwilling | 219/268 |
| 2,535,665 | 12/1950 | Boyarsky et al. | 219/268 |
| 2,748,246 | 5/1956 | Lewis | 219/268 X |
| 3,007,027 | 10/1961 | Hall | 219/268 |
| 3,125,662 | 3/1964 | Alvarez et al. | 219/262 |
| 3,277,271 | 10/1966 | Hunt | 219/268 |
| 3,379,856 | 4/1968 | Hirsch | 219/268 |
| 3,419,704 | 12/1968 | Hunt | 219/268 |

*Primary Examiner*—Volodymyr Y. Mayewsky

[57] ABSTRACT

The present invention provides an ignition device for tobacco associated items such as cigars and cigarettes which is activated by a battery and only upon activation of a switch which connects the heating grid for the tobacco item and the battery which provides the necessary electrical power to cause the ignition. The device is protected from the accidental activation of the heating element due to the presence of moisture.

4 Claims, 7 Drawing Figures

DISPOSABLE ELECTRIC LIGHTER

FIELD OF THE INVENTION

The present invention is in the area of tobacco appliances and more specifically in the area of those appliances developed to cause ignition of cigars and cigarettes and even more specifically those appliances as previously described which are disposable.

BACKGROUND OF THE INVENTION

Probably the first disposable lighter for items containing tobacco was a twig which was placed into a fire and then the resulting flame was brought to the cigarette. In between matches were developed which were in a sense disposable lighters in that once they had been struck and a fire caused they were then extinguished and disposed of. Subsequently, through the ingenuity of man came a lighter which was in a sense was partially disposable in that it was filled with a flamable liquid which could be ignited by a spark. There were also lighters which contained a fluid and a grid which could be heated when air was drawn through the lighter to cause the grid to become incandescent and subsequently light the tobacco item with which it was being used. By in large, most lighters relied on a fuel system which in a sense was not disposable in the fact that the lighter case need not be thrown away. It could be reactivated by the insertion of additional fuel. The advent of the butane fuel disposable lighter brought about considerable change in the field of ignition devices for tobacco products of the cigarette and cigar type. With the butane fuel device, when the butane fuel was exhausted, the lighter was then disposed of. There have been attempts to provide other means of fueling lighters such as with batteries which would be replaced and then the lighter would continue to be useful.

The battery activated lighter was in a sense a partially disposable lighter in that the battery of course could be disposed of. The other liquid fuel lighters of a disposable nature could be classified as those in which the fuel was replaced or those in which the lighter was disposed of after the fuel that was in the lighter as purchased was exhausted. All the foregoing lighters required the activation of flame in order to ignite the tobacco product to which the lighter had been applied. The fueled lighters were susceptible, as might well be expected, to being ignited by children and as a result accidentally induced fires within a home could be easily produced by the mere fact that the flame was present which could ignite any material which was in reasonably close contact therewith.

SUMMARY OF THE PRESENT INVENTION

The present invention provides a disposable lighter which does not produce a flame which is susceptible to inciting flamability of any object brought in contact therewith. The present invention is a lighter which provides only a heated grid to ignite the tobacco product which must be inserted therein and as a result is not susceptible to creating a fire from objects thereby. The present invention also is characterized by the fact that the power source which provides the necessary heat to ignite the tobacco appliance is a part of the container or the casing for the lighter per se.

BRIEF SUMMARY OF THE INVENTION

The present invention provides an ignition device for tobacco associated items such as cigars and cigarettes which is activated by a battery and only upon activation of a switch which connects the heating grid for the tobacco item and the battery which provides the necessary electrical power to cause the ignition. The device is protected from the accidental activation of the heating element due to the presence of moisture.

DESCRIPTION OF THE DRAWINGS

The present invention will be described in embodiments as illustrated in the following drawings. The illustrative embodiments shown in the drawings are considered only to be exemplary of the concept of the present invention and its arrangements as to elements may be modified by those with skill in the art.

DETAILED DESCRIPTION OF THE PRESENT INVENTION

Figure 1:
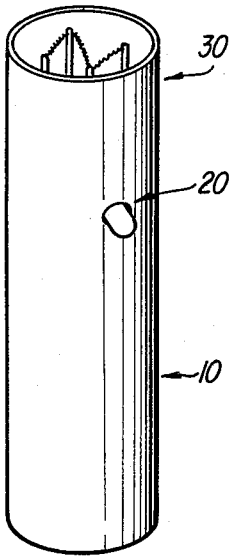
FIG. 1 is a perspective view of the present invention as would be presented to the purchaser.

With reference to FIG. 1, it will be seen that the present invention comprises an elongated cylindrical object having a base portion 10 which provides a source of electrical energy, a switch portion 20, and an ignition portion 30.

Figure 2:
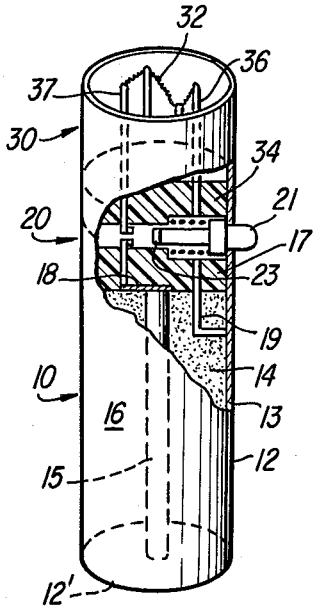
FIG. 2 is a partial sectional perspective view of one illustrated embodiment of the present invention.

Referring now to FIG. 2, it will be seen that the base portion 10 comprises a plastic cylindrical wall 12 with plastic bottom wall 12' which, in addition to forming the casing for portions 20 and 30, also provides the outer casing for the electrical energy. The electrical energy within the base portion 10 conventionally will contain a zinc foil lining 13 and a conventional alkaline battery composition 14 and an electrode 15 to constitute a battery 16 as the source of ignition energy for the present invention. The battery 16 is provided with a nonconductive cap and battery seal 17. From the electrode 15 there extends upwardly through cap 17 a contact element 18. Another contact element 19 extends from the zinc liner 13 of the battery, also upwardly through cap 17.

At the outer ends of the grid element 32 are contacts 36 and 37. These contacts extend down through the nonconductive material 34 forming the block. It will be noted that contact 37 is not brought into conductive contact with contact element 18 of the battery 16 when the battery lighter is assembled. The contact element 36 is so positioned as to be placed in conductive contact with element 19 of the battery 17. The contacts 37 and 36 extend below the bottom surface of the block 33.

Figure 4:
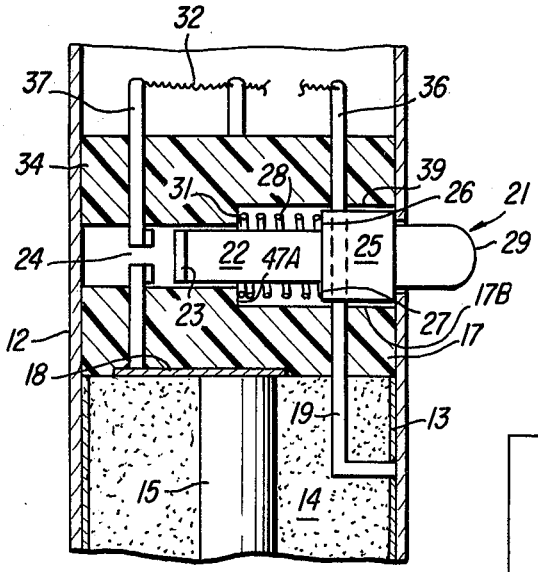
FIG. 4 is a partial cross sectional view of the switch means which activates the present invention.
Figure 7:
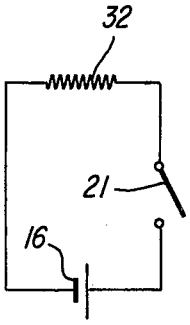
FIG. 7 is a perspective view of the ignition element block which is inserted in the top of the lighter case and which provides a seal for the upper part of the lighter in FIG. 5.

Referring now to FIG. 4, it will be apparent that the circuitry in this lighter can be activated by means of a switching assembly 21. The switch assembly 21 comprises an elongated element 22 of a nonconductive material having on its inner end a conductive portion 23 which will be observed to be of sufficient size to bridge the gap 24 which normally will exist between contact elements 18 of the battery and 37 of the ignition grid. The outer portion of the element 22 contains an enlarged cylindrical portion 25 which provides shoulders 26 and 27 on each side thereof. The shoulder 26 provides a base for one end of the biasing element 28 which encircles the enlongated portion 22. The other end of the biasing element 28 is supported by the shoulder 31 on the underside of the block 34 which is formed by the cutting of a semi-circular recess 39. The cap 17 of the battery 16 similarly has a shoulder 17A which engages the other end of the biasing element 28 and is formed by a recess 17B, formed on the upper surfaces of cap 27. The shoulder 27 on the switch assembly enlarged portion 25 of switch assembly 21 serves as a stop to retain the switch assembly 21 within the wall 12. It also serves as a seal against the entry of any moisture through opening 11A in casing 11 due to the biasing action of element 28. To operate the lighter of the present invention, it will be apparent that inward movement of the switching assembly 21 closes the gap 24 between the contact elements 37 and 18. Upon release of pressure on the end 29 of the switching assembly 21, the assembly is pushed outwardly into contact so that shoulder 27 makes contact with the inner wall 12.

Figure 3:
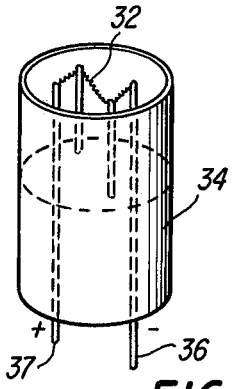
FIG. 3 is a perspective view in partial sections of the heating means of the present invention as shown in one embodiment.
Figure 6:
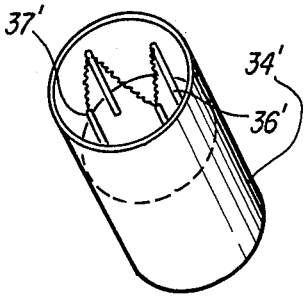
FIG. 6 is a circuit diagram of the present invention.
Figure 5:
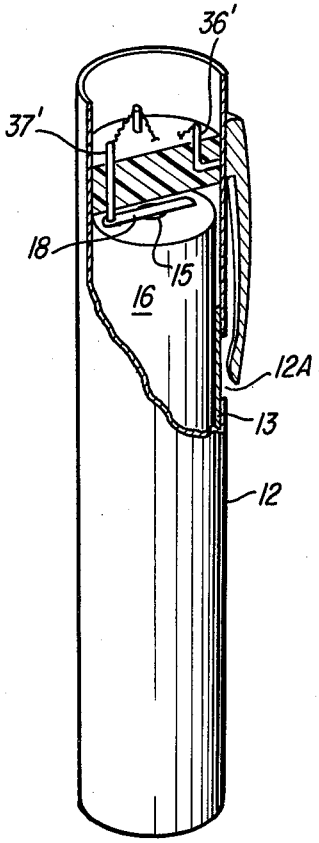
FIG. 5 is a perspective view of an alternate embodiment of the present invention with reference to the switching portion.

Referring now to FIG. 5, it will be seen that the same basic contact elements are present but are connected in a manner different than that illustrated in FIGS. 3 and 4. In this instance, the contact element 18' from the battery 16 is in contact with the contact element 37' of the heating element block. Contact element 36' of the heating element block is connected to one end of a clip. The other end of the clip is depressed through the opening 12A in the wall 12 and makes contact with the zinc foil 13 when depressed.

The present invention has been illustrated being two embodiments and other variations and arrangement of the elements may be made by those with skill in the art without departing from the scope of the present invention as set forth in the following claims.

What is claimed is:

1. A disposable electric lighter comprising a casing of non-conductive thermoplastic material having one end closed and the opposite end open, the casing being monolithic and providing the outer covering for a source of electric energy placed in the closed end portion of the casing which electric energy source comprises zinc foil liner in contact with the inner surface of said casing over at least half the length of the casing, conventional alkaline battery composition within said foil and in electrical contact therewith and an electrode within said composition extending upwardly therethrough to the upper surface of said composition, a cap of non-conductive material sealing the upper surface with a recess in a portion of the top of said cap, a first contact element extending from said electrode upwardly through said cap and a second contact element extending from said foil liner upwardly through said cap and diametrally spaced from said first contact; and ignition assembly sealingly positioned in spaced relationship with said electrical energy source cap and below said open end of said casing, said assembly having two contact elements depending therefrom, one of said contact elements making electrical contact with said second contact element of said energy source, the other of said contacts being spaced from said first contact element of said energy source, the assembly further having a recess on a portion of its underside; and switching means positioned between said energy source cap and the underside of said ignition assembly in the respective recesses of said cap and said underside and adapted to be selectively placed in electrical contact with said energy source first contact and said assembly other contact simultaneously.

2. The lighter, according to claim 1, wherein said ignition assembly comprises a resistance element supported above a disc of nonconductive material, each end of said resistance element having a contact element extending downwardly therefrom through said disc, said disc being of a size to fixingly engage the inner walls of said casing in the upper portion in a recessed postion, one of said contact elements being so positioned as to make contact with said foil, the other of said contacts being positioned relative to the contact element from said electrical energy portion as to form a gap between the two contact elements.

3. The lighter, according to claim 1, wherein said switching means comprises an elongated element of nonconductive material, having an end cap of conductive material on its inner portion and biasing means on said switch and said elongated portion to restrain said conductive end portion from contact elements from said ignition means and said electrical energy means.

4. The lighter, according to claim 3, wherein said elongated portion has an enlarged cylindrical section which in part abutts the inner wall of said casing and in part extends outwardly through an opening in said casing, said abutting portion forming a seal for said opening when said lighter is inactive.

* * * * *